United States Patent [19]

Lodato et al.

[11] 4,068,911

[45] Jan. 17, 1978

[54] WASHER AND CONNECTOR ASSEMBLY

[75] Inventors: Alphonso Lodato, Corona; Americo Cornacchio, Mount Vernon, both of N.Y.; Edward M. Fox, Waldwich, N.J.

[73] Assignee: Kings Electronics Company, Inc., Tuckahoe, N.Y.

[21] Appl. No.: 737,150

[22] Filed: Oct. 29, 1976

Related U.S. Application Data

[62] Division of Ser. No. 672,136, March 31, 1976.

[51] Int. Cl.[2] ..... H01R 13/54

[52] U.S. Cl. ..... 339/90 R; 339/90 C

[58] Field of Search ..... 85/51; 285/316, 321, 285/85, 86; 339/88 R, 89 R, 89 C, 90 R, 90 C, 188 C

[56] References Cited

U.S. PATENT DOCUMENTS

| | | | |
|---|---|---|---|
| 3,665,371 | 5/1972 | Cripps | 339/90 C |
| 3,754,206 | 8/1973 | Obeissart | 339/90 R |

FOREIGN PATENT DOCUMENTS

| | | | |
|---|---|---|---|
| 1,401,373 | 7/1975 | United Kingdom | 339/90 R |

*Primary Examiner*—Roy Lake
*Assistant Examiner*—E. F. Desmond
*Attorney, Agent, or Firm*—Bierman & Bierman

[57] ABSTRACT

A connector of the bayonet type in which a bayonet sleeve is installed on the body of the connector, the sleeve being moveably held to the body by a spring and an open end washer. The open end washer has a generally circular envelope, opens at one edge and is cut back or notched to a selected degree at the opposing side to permit the washer to be slipped onto the connector and then closed.

5 Claims, 7 Drawing Figures

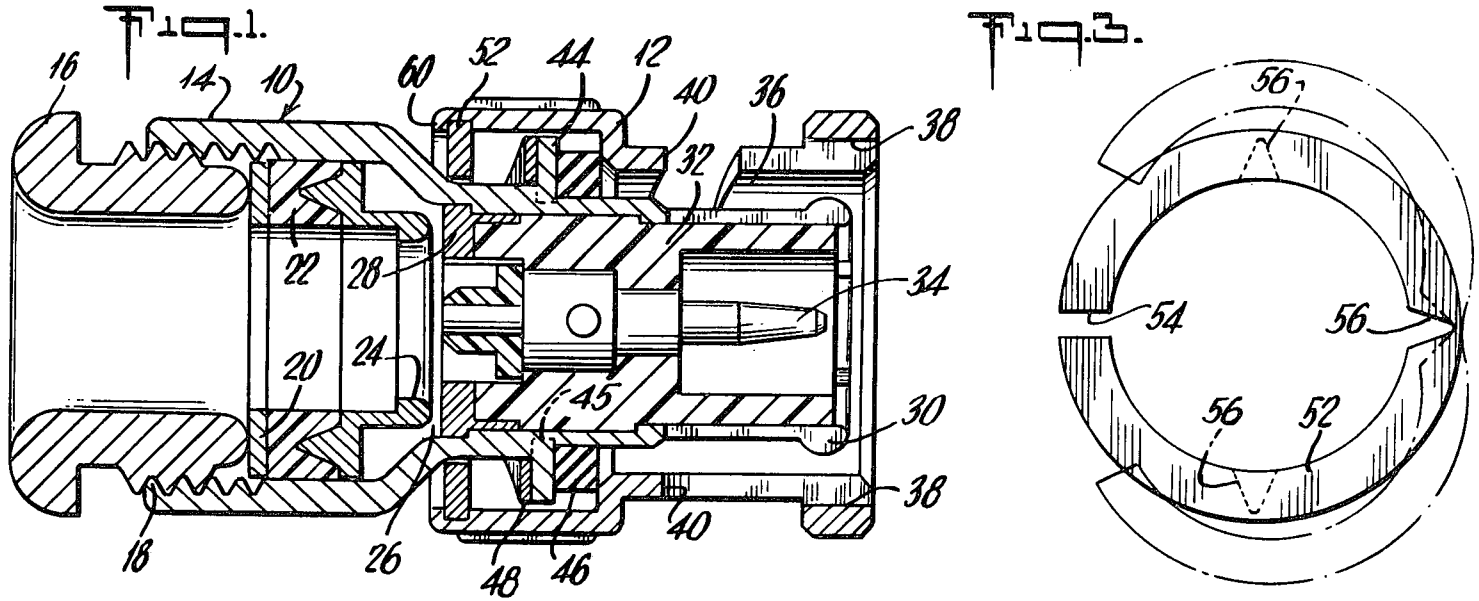
Fig. 1.
10
12
14
16
18
20
22
24
26
28
30
32
34
36
38
40
44
45
46
48
52
60
Fig. 3.
52
54
56
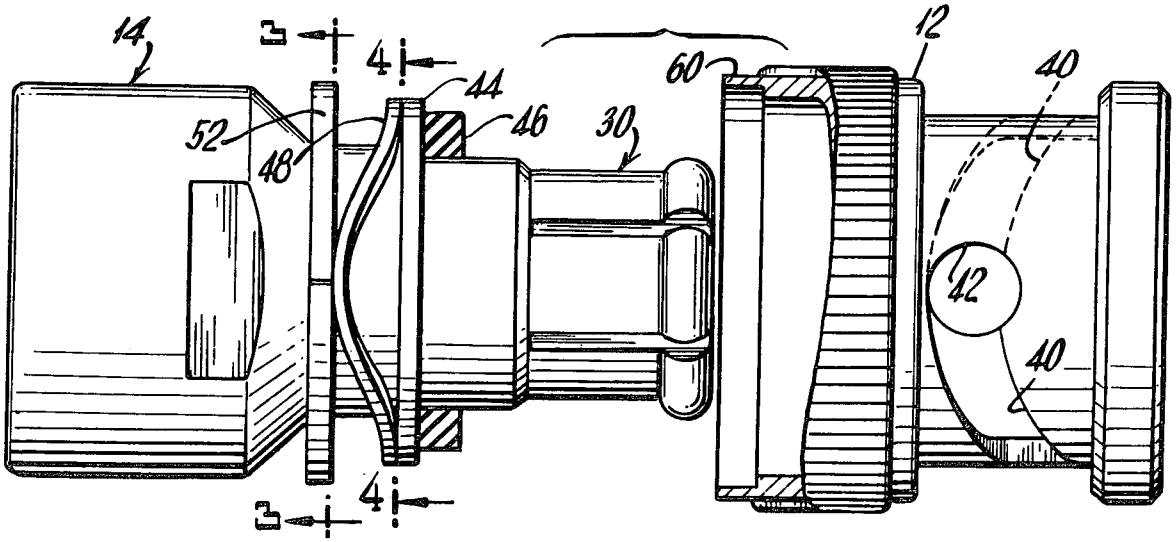
Fig. 2.
12
14
30
40
42
44
46
48
52
60
3
4

WASHER AND CONNECTOR ASSEMBLY

This is a divisional of application Ser. No. 672,136 of Mar. 31, 1976.

This invention relates to connectors and more particularly to cable connectors having a bayonet sleeve. The invention also relates to special washers which can easily be installed on the connectors.

The term connector is used in this specification in its broadest sense and includes any item which can perform a connection function such as adapters of all kinds, panel mount receptacles, terminations, T-adapters, bulk head receptacles, hollow tubing or any crossectional shape, or solid rod or fibers etc. The construction of these units is in principle the same as for the particular connector selected for description in this specification i.e. a body to which a sleeve may be mounted. Accordingly, such other types of connectors have not been illustrated herein.

Bayonet connectors have been available commercially for a long time. They are generally made in two parts, one being the connector body, the other being the sleeve. The sleeve is provided with an elongated opening in its surface which receives mating pins or other engaging means located on the cable for engaging the opening. Generally, the cables inserted into these connectors are provided with mating connectors. A simple twist of the sleeve or cable forces the mating pins or other engaging means solidly into the sleeve to lock it in position in one or more detents that are provided at the end of the run of the elongated opening.

Typical bayonet type connectors are rather difficult to assemble. The sleeve is assembled to the body via a spring and washer assembly. This permits the sleeve to move slightly with respect to the connector body against the force of the spring when inserting the mating member. This permits the mating member to engage the detents, and it also permits the mating member to be disengaged from the detents and removed from the sleeve.

Conventional bayonet assemblies use a split circular spring which is installed on the connector body and against a shoulder. The springs used are generally circular in shape, like a washer, and in side view have the appearance of a bow, substantially as shown in FIG. 2 of the drawings. In order to provide for a second shoulder to support the other side of the spring, a pair of half washers have been employed. These half washers are extremely difficult to install, are generally installed by hand and require a high level of skill. Although a circular cross-sectional connector is described herein, the connector can assume any other shape such as square, hexagonal, etc.

Hand installation of the half washers also makes it necessary to complete the assembly of sleeve to connector body by hand, since the half washers must be held in place as the sleeve is slipped over the body.

To overcome the above deficiencies, a new type of open end washer is provided in which the open end washer is slit at one side and preferably cut back somewhat at a point removed from the said slit to permit the washer to be opened and placed on the body of the connector and then closed. This new open end washer retains its integral nature and once installed, does not have to be held in place by hand. This will permit the use of automated methods of assembling the sleeve to the connector body. In addition, the use of skilled labor so essential to installing the half washers of the prior art may be eliminated by the appropriate design of automatic equipment for installing the new open end washers.

Referring now to the drawings in which a single preferred embodiment is disclosed and in which like numerals refer to like parts:

FIG. 1 is a detail view of a bayonet type connector assembly;

FIG. 1*a* is a plan view of a snap ring;

FIG. 2 is an exploded view of the connector body and sleeve of FIG. 1 prior to assembly;

FIG. 3 is a plan view of the open end washer of the present invention; and

Figure 1A:
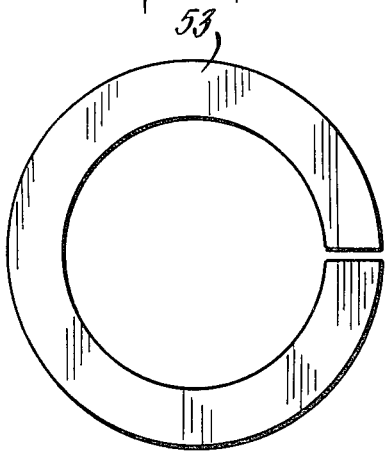

Referring now to the drawings, the numeral 10 denotes the connector body and the numeral 12 denotes the bayonet sleeve.

The connector body 10 of the connector shown in the drawings is provided with an enlarged rear portion 14 adapted to accept a cable (not shown). The internal parts of the connector body chosen for purposes of illustration are conventional and will be but briefly described. Specifically, a conventional clamp nut portion 16 is shown. The plug portion and connector body are provided with cooperating screw threads 18 for mating the connector body to the clamp nut. An internal washer 20, elastomeric gasket 22, and braid clamp 24 are mounted in the connector body portion 14, there being a space 26 between the braid clamp 24 and a bushing 28 inserted in the forward end of the connector body. The braid from the cable (not shown) is pulled back and inserted in space 26, all in conventional fashion.

The connector body contains a conventional insulator 32 and a contact 34 mounted in the insulator. The contact 34 is adapted to electrically connect to another connector (not shown).

Bayonet sleeve 12 surrounds the forward end 30 of the connector body. It will be noted at this point that the forward end 30 has a smaller diameter than the rear portion 14, and that the bayonet sleeve does not add substantially to the overall envelope of this particular connector.

Bayonet sleeve 12 has an internal diameter which is larger than the outer diameter of the forward end 30 of the connector body, the space between these two components being denoted by the numeral 36. Into this space is inserted a mating connector. The mating connector is provided with a pair of upstanding lugs or projections (not shown). The lugs are preferably opposite each other, and the tip to tip distance between them is greater than the internal diameter of the bayonet sleeve 12 in the region of space 36. The bayonet sleeve is grooved at 38 to permit insertion of the mating connector lugs into the connector, the lugs engaging in elongated bayonet openings 40. A twist of the mating connector or bayonet sleeve causes the lugs to be carried in the elongated opening back towards the rear until the lugs reach the detents 42. As shown in the drawings, there are present two elongated bayonet openings 40 and two detents 42. More can be used if desired.

The connector body is provided with a shoulder 44. A gasket 46 is mounted forward of the shoulder 44 and spaces the bayonet sleeve from the shoulder.

Figure 4:
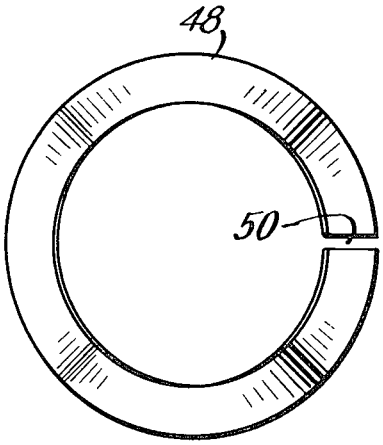
FIG. 4 is a plan view of a spring useful in the present invention.

A spring washer 48 having a bowed shape is provided on the other side of the shoulder 44. When an integral shoulder 44 is used, the spring is slit at 50 (FIG. 4) to permit installation of the spring washer over the portion 44 of the connector body. The spring washer is preferably made of metal and retains the shape shown in FIG. 4 after installation.

Next is the open end washer 52, which is most clearly seen in FIG. 3. The open end washer acts as a rear shoulder for the spring 48. The open end washer is slit at 54 and is further cut back or notched at one or more locations 56. Using one notch back 56 opposite the slit permits the open end washer as shown in dotted lines of FIG. 3 to be bent to the shape indicated by the solid lines in FIG. 3 for installation between the spring washer 48 and the enlarged rear portion 14 of the connector body. The cross-sectional shape of the open end washer will of course correspond to the cross-sectional shape of the connector body.

The completed connector body assembly with gasket 46, spring washer 48 and open end washer 52 is shown in FIG. 2. When using a single cut back 56, it is to be understood that the cut back can be located anywhere desired along the washer as long as the opening obtained is sufficient to permit installation of the washer on the connector body. Of course, multiple cut backs, as shown may be used to advantage.

The open end washer is preferably made of metal although any material can be used which is appropriate. For best results, the cut back 56 is made sufficiently deep so that any major bending movement of the two portions of the washer on either side of the cut back will result in plastic deformation of the washer. The washer should be able to hold both its open and closed positions.

The open end washer may be made from a conventional washer by slitting the washer at 54 and cutting or notching it somewhat at 56. Alternatively, the washer may be cast or fabricated by any other method. The manufactured shape may be either open (dotted-line position in FIG. 3) or closed (full-line position in FIG. 3).

Figure 5:
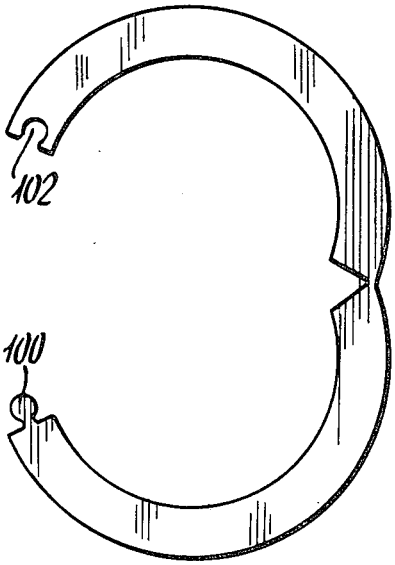
FIG. 5 is a plan view of another embodiment of an open end washer.

In a second embodiment, as shown in FIG. 5, the open end washer is provided with a closure at the slit comprising a tongue and groove 100, 102, respectively. When the open end washer is closed, the tongue 100 is placed into groove 102 to lock the respective sides of the washer to each other.

Figure 6:
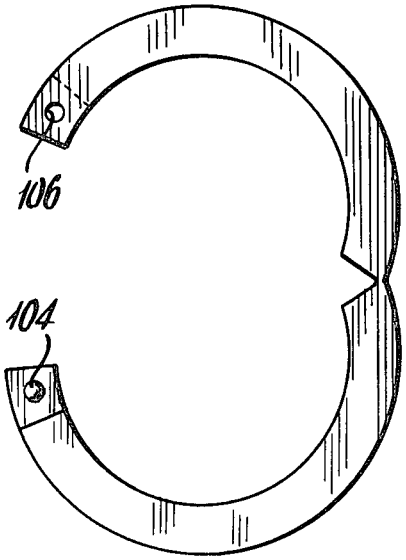
FIG. 6 is still another embodiment of the open end washer of the instant invention.

Alternately, the embodiment of FIG. 6 may be used. In this embodiment, the tongue 100 is replaced by a protrusion 104 and a corresponding hole or blind hole 106 replaces groove 104. Preferably, the thickness of the open ends of the washer are shaved or beveled somewhat as shown in FIG. 6 to permit the side of the washer containing the protrusion to slide easily under or over the other side of the washer, as the case may be, to lock the washer into closed position. The above described embodiments of open end washers are preferred structures only. Other structures can be adapted which may work equally well, provided that they can be closed, or opened and closed, as the case may be, to permit installation on the connector body.

The conventional prior art washer is a composite of two independent half washers (not shown). To facilitate understanding of what is meant by half washers, continue the notchcut 56 (FIG. 3), thus completely cutting the open end washer in half. Each of these sections would then correspond to a half washer. The half washers would then individually be placed by hand on the connector body behind the spring washer. It can be readily appreciated that the spring washer would contact the half washers only at two points denoted by the numeral 58. At best, the ability of the spring washer to retain each of these half washers in place on the connector body is limited.

Use of the half washers tended to make it difficult to insert the connector body 10 into the bayonet sleeve 12 by any method other than by hand, since the half washers were so easily dislodged. Even hand installation was difficult and required a level of manual dexterity which was difficult for the operator to develop. The open end washer 52 of the present invention is much easier to place in position. It also will not fall off and permits simple, rapid installation of the connector body assembly into the bayonet sleeve.

The shoulder 44 may either be integral with the connector body or it may be a separate item. If a separate item is to be used, then it is preferred to groove the periphery of the connector body as shown in dotted lines and denoted by the numeral 45 in FIG. 1. A snap ring 53 or open end washer may then be inserted in the groove to provide the needed shoulder surface.

Most connectors of the bayonet type have been made using an integral shoulder 44. Elimination of the integral shoulder in favor of a snap ring or open end washer permits the spring to be slipped on over the forward portion of the connector, thereby eliminating the need to slit the spring.

As shown in FIG. 1, the rear tip or lip 60 of the bayonet sleeve is formed over to engage the open end washer after the connector body has been inserted. This completes the assembly of the various parts of the connector.

Returning to the mating connector inserted through the forward end of the connector, it will be appreciated that simply rotating the bayonet sleeve will anchor the cable in place via the mating connector. To remove the mating connector, the bayonet sleeve 12 can be moved forward against the return force of the spacer washer, thereby permitting the cable lugs to move out the detents 42. Reverse rotation of the sleeve will then cause the cable lugs to ride outwardly in the elongated bayonet openings 40 until they are positioned adjacent grooves 38. The mating connector is then removed. Only one type of bayonet connector has been illustrated. There are many types available on the commercial market all of which can benefit from the invention disclosed herein. For instance, the integral shoulder 44 can be replaced by an open end washer. Angle type connectors can employ the open end washer. The open end washer is shown most advantageously employed in a connector in which a simple conventional annular washer cannot be used, because it cannot be slipped over the various interfering parts of the connector, such as the shoulder 44 and the enlarged rear portion 14 of the connector body. Nevertheless, it is to be understood that the open end washer can be utilized to advantage —even in other types of connectors or others in which obstruction to the simple installation of a conventional washer does not exist.

Although a single spring washer has been shown in the drawings, it is to be understood that a plurality of spring washers can be placed together and installed in place of the single one shown.

Modifications of the subject matter of the invention described above and shown in the drawings may occur to those skilled in the art. It is intended to cover all such modifications which do not depart from the spirit and scope of the invention as defined in the claims appended hereto.

What is claimed is:

1. A bayonet type connector assembly comprising a body and a sleeve, said sleeve having at least one elongated opening therein, a spring washer and an open end washer between said body and said sleeve, shoulder means against which one end of said spring washer abuts, the other end of said spring washer abutting against said open end washer, said spring washer being firmly anchored between said open end washer and said shoulder means to allow relative movement between said sleeve and said body, said body having a forward portion and a rear portion, the forward portion being of lesser diameter than the rear portion, said spring washer, shoulder means and open end washer being mounted on said forward portion, said spring washer being slit on one side thereof to permit installation of said spring washer onto said body, said open end washer being slit at one side and being provided with at least one notch cut at a point spaced from said slit a distance sufficient to permit the open end washer to have an opening large enough to permit the said washer to be mounted on said connector body.

2. The bayonet type connector according to claim 1 wherein said shoulder means comprises an open end washer.

3. The bayonet type connector according to claim 1 wherein there is one said notch cut located opposite said slit.

4. The bayonet type connector according to claim 1 wherein said open end washer is made of metal.

5. The bayonet type connector according to claim 4 wherein said open end washer is sufficiently weakened in the area of said notch cut to permit the washer to sustain plastic deformation in the area of said notch cut when said open end washer is moved from one of said positions to the other.

* * * * *